US005771421A

United States Patent [19]

Kim

[11] Patent Number: 5,771,421

[45] Date of Patent: Jun. 23, 1998

[54] METHOD OF CONTROLLING FUSING OF AN IMAGE FORMING APPARATUS

[75] Inventor: Soon-Nam Kim, Suwon, Rep. of Korea

[73] Assignee: SamSung Electronics Co., Ltd., Suwon, Rep. of Korea

[21] Appl. No.: 832,618

[22] Filed: Mar. 31, 1997

[30] Foreign Application Priority Data

Mar. 29, 1996 [KR] Rep. of Korea ..... 96-9191

[51] Int. Cl.[6] ..... G03L 15/20

[52] U.S. Cl. ..... 399/44; 399/70

[58] Field of Search ..... 399/44, 66, 67, 399/70

[56] References Cited

U.S. PATENT DOCUMENTS

| | | | |
|---|---|---|---|
| 4,318,612 | 3/1982 | Brannan et al. | 399/70 |
| 4,324,486 | 4/1982 | Nishikawa | 399/70 |
| 4,609,278 | 9/1986 | Taniguchi | 399/70 |
| 4,996,567 | 2/1991 | Watarai et al. | 399/70 |
| 5,138,379 | 8/1992 | Kanazashi | 399/44 |
| 5,276,483 | 1/1994 | Hasegawa et al. | 399/44 |
| 5,367,325 | 11/1994 | Yano et al. . | |
| 5,394,177 | 2/1995 | McCann et al. . | |
| 5,406,315 | 4/1995 | Allen et al. . | |
| 5,422,665 | 6/1995 | Stephany et al. . | |
| 5,424,767 | 6/1995 | Alavizadeh et al. . | |
| 5,467,113 | 11/1995 | Ishinaga et al. . | |
| 5,485,179 | 1/1996 | Otsuka et al. . | |
| 5,485,182 | 1/1996 | Takayanagi et al. . | |
| 5,502,467 | 3/1996 | Hoisington et al. . | |
| 5,576,745 | 11/1996 | Matsubara . | |
| 5,581,281 | 12/1996 | Fuse . | |
| 5,610,637 | 3/1997 | Sekiya et al. . | |

*Primary Examiner*—Joan H. Pendegrass
*Attorney, Agent, or Firm*—Robert E. Bushnell, Esq.

[57] ABSTRACT

A method of fusing image is for an image forming apparatus including a paper feeder, a photosensitive device having an organic photoconductive (OPC) drum to form an electrostatic latent image on the peripheral surface of the OPC drum, a transferring device for supplying toner powder to the electrostatic latent image and for transferring the toner image on a paper, and a fusing device for fusing the toner image on the paper. The method includes the steps of: measuring ambient temperature and humidity of the transferring device when power is supplied and judging whether or not the transferring device is at low temperature and low humidity by comparing the measured values and set values; after the judgement, heating the fusing device for a first warm-up time if not at low temperature and low humidity or for a second warm-up time if at low temperature and low humidity; and if a print command is inputted after heating of the fusing device, controlling the photosensitive and the transferring device and fusing the transferred toner image on the paper, thereby completing the print. According this fusing step, the fusing device is heated sufficiently when the image forming device is activated at low temperature, whereby poor fusing caused by insufficient heating of the fusing device is prevented.

18 Claims, 4 Drawing Sheets

METHOD OF CONTROLLING FUSING OF AN IMAGE FORMING APPARATUS

CLAIM OF PRIORITY

This application makes reference to, incorporates the same herein, and claims all benefits accruing under 35 U.S.C. §119 arising from an application for Method of Controlling Fusing of An Image Forming Apparatus earlier filed in the Korean Industrial Property Office on 29 Mar., 1996 and there duly assigned Serial No. 96-9191.

BACKGROUND OF THE INVENTION

1. Field of the Invention

The present invention relates generally to a method of producing an electrophotographic image using an image forming apparatus such as a laser printer. More particularly, the present invention relates to the field of endeavor in which during a fusing step, the apparatus heats a fusing device sufficiently when the image forming apparatus is activated at low temperature to prevent poor fusing caused by insufficient heating of the fusing device.

2. Description of the Related Art

An electrostatic copying system such as a copier, laser printer, etc., is typically requires temperature measurement during such an operation as follows. A charger roller charges photosensitive substance on the peripheral surface of a rotating organic photoconductive (OPC) drum. Then, the surface is exposed to an exposure device, for example a laser diode emitting light, to create an electrostatic latent image thereon. Thus, a formed latent image attracts and holds toner powder when passing a developing roller. The toner image is then transferred to paper fed by a paper feeder and fused on the paper by the heat and pressure of a heating roller.

Such an image forming apparatus enters a warm-up mode as soon as power is on. After a warm-up operation, it proceeds to on-line mode capable of executing a print command. However, a standby mode starts automatically if the on-line mode is over a predesignated time with no input command, and if a command is inputted during the standby mode, a printing job is carried out after a rewarm-up operation. In such an apparatus, it is generally known that energy required for the fusing step is produced by heating the heating roller by means of a heating lamp ofthe fusing device during the warm-up operation.

However, when the print command is inputted after the device has been at atmospheric temperature of about 10° C. and humidity of about 30% RH more than two hours without operation, it is impossible to heat the heating roller sufficiently within a usual warm-up period, deteriorating the fusing performance. Among exemplars of the contemporary practice on this matter, Sekiya et al. (U.S. Pat. No. 5,610,637, Ink Jet Recording Method, Mar. 11, 1997) discusses repeatedly input a set of driving pulses so that the heater element is repeatedly activated by the driving pulses. Fuse (U.S. Pat. No. 5,581,281, Ink Jet Recording Apparatus Having Drive Pulse Width Control Dependent On Printhead Temperature, Dec. 23, 1996) discusses quickly completing a preparatory driving operation and suppressing the wasteful condition of the ink even if the apparatus is used in a cold environment after the apparatus has been held inoperative for a long time. Matsubara (U.S. Pat. No. 5,576,745, Recording Apparatus Having Thermal Head And Recording Method, Nov. 19, 1996) discusses determining a thermal change state of the thermal head and a driving condition of the mounted thermal head in accordance with the determined thermal change state. Hosington et al. (U.S. Pat. No. 5,502,467, Ink Jet Printhead With Ink Viscosity Control, Mar. 26, 1996) discusses a printing system with controlling system for controlling a heater so as to control the temperature of the ink in order to maintain viscosity at a desired level. Otsuka et al. U.S. Pat. No. 5,485,179, Ink-Jet Recording Apparatus And Temperature Control Method Therefor, Jan. 16, 1996) discusses a printer with a temperature sensor for measuring an ambient temperature and a timer for measuring a time associated with a temperature variation. Takayanagi et al. (U.S. Pat. No. 5,485,182, Liquid Jet Recording Apparatus, Jan. 16, 1996) discusses preventing change in properties of recording liquid, such as surface tension, viscosity, etc. by measuring temperature and heating accordingly. Ishinaga et al. (U.S. Pat. No. 5,467,113, Ink-Jet Recording Head, Board For Said Head And Ink-Jet Recording Apparatus, Nov. 14, 1995) discusses a printer having a heater array as well as sensors for detecting the temperature of the board. Alavizadeh et al. (U.S. Pat. No. 5,424,767, Apparatus And Method For Heating Ink To A Uniform Temperature In A Multiple-Orifice Phase-Change Ink-Jet Print Head, Jun. 13, 1995) discusses a control of temperature of a rotating drum of a printer. Stephany et al. (U.S. Pat. No. 5,422,665, Low-Interference Thermistor For A Thermal Ink Jet Printhead Chip, Jun., 6, 1995) discusses a printer with a thermistor design that reduces electromagnetic interferences. Allen et al. (U.S. Pat. No. 5,406,315, Method And System For Remote-Sensing Ink Temperature And Melt-On Demand Control For A Hot Melt Ink Jet Printer, Apr. 11, 1995) discusses a control of temperature level of a recording material. McCann et al. (U.S. Pat. No. 5,394,177, Four Inch Fluid System, Feb. 28, 1995) discusses control of vacuum level as well as control of ink temperature and pressure. Yano et al. (U.S. Pat. No. 5,367,325, Recording Apparatus With Temperature Detection And Compensation, Nov. 22, 1994) discusses a detector for detecting temperature distribution. From my study of the contemporary practice and of the art, I find that there is a need for an effective and improved method of operation of an image forming apparatus which results in good fusing of the toner image by heating the heating roller sufficiently in any case, especially by considering not only the temperature but also the humidity.

SUMMARY OF THE INVENTION

Therefore, an object of the present invention is to provide a new method of operation of an image forming apparatus which results in good fusing of the toner image by heating the heating roller sufficiently in any case.

Another object of the present invention is to provide a new method of operation of an image forming apparatus which can minimize the power consumption by turning on the heating lamp in only when the apparatus has been at low temperature and low humidity for a long time.

These objects and others of the present invention may be achieved by a method for controlling fusing step of an image forming device which includes a paper feeder, an organic photoconductive (OPC) drum unit having an organic photoconductive drum for creating an electrostatic latent image, a transfer device for supplying toner powder to the latent image and for transferring the toner image on a paper, and a fusing device for fusing the transferred image on the paper. The method may include measuring atmospheric temperature and humidity in response to application of the initial power and determining whether or not the atmospheric condition is at low temperature and humidity by comparing the measured values and set values. If not at low temperature and humidity, the fusing device may be heated for a first set warm-up time. If at low temperature and humidity, then the fusing device may be heated for a second set time. If a print command is inputted after the fusing device heating step, there may be fusing the transferred toner image on the paper by controlling the photosensitive device and the transfer device, thereby finishing printing. In such a method, it is desirable that the second set time is longer than the first set time, sometimes most desirable at being longer by as much as 10 to 20 seconds.

The above mentioned objects can be achieved according to another embodiment of the present invention using a method for controlling fusing step of an image forming device which includes a paper feeder, a photosensitive device having at least one OPC drum for creating an electrostatic latent image, a transfer device for supplying toner powder to the latent image and for transferring the toner image on a paper, and a fusing device for fusing the transferred toner image on the paper. The method may be include measuring atmospheric temperature and humidity if a print command is inputted in standby mode after power is supplied and determining whether or not the atmospheric condition is at low temperature and humidity by comparing the measured values and set values; if not at low temperature and humidity, heating the fusing device for a first set warm-up time; if at low temperature and humidity, heating the fusing device for a second set time; if a print command is inputted after the fusing device heating step, fusing the transferred toner image on the paper by controlling the photosensitive device and the transfer device, thereby finishing printing. If a print command is inputted in standby mode, it is desirable that the second set time is longer than the first set time by as much as 10 to 20 seconds.

The foregoing object can be achieved according to still another embodiment of the present invention by a method for controlling fusing step of an image forming device which includes a paper feeder, a photosensitive device having at least one OPC drum for creating an electrostatic latent image, a transfer device for supplying toner powder to the latent image and for transferring the toner image on a paper, and a fusing device for fusing the transferred image on the paper. The method can include the first step of measuring atmospheric temperature and humidity in response to application of the initial power and determining whether or not the atmospheric condition is at low temperature and humidity by comparing the measured values and set values; the second step of, if not at low temperature and humidity, heating the fusing device for a first set warm-up time and maintaining standby mode; the third step of, if at low temperature and humidity, heating the fusing device for a second set time and maintaining standby mode; the fourth step of, if a print command is inputted in the standby mode, fusing the transferred toner image on the paper by controlling the photosensitive device and the transfer device, whereby finishing printing; the fifth step of, if no print command is inputted in the standby mode, maintaining standby mode; and the sixth step of, if a print command is inputted in the standby mode of the fifth step, performing the entire steps except for the standby mode, whereby producing print result. In such method, it is desirable that the second set time is longer than the first set time. Moreover, if a print command is inputted in the standby mode, it is desirable that the second set warm-up time is longer than the first set warm-up time as much as about 20 seconds.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENTS

Figure 1:
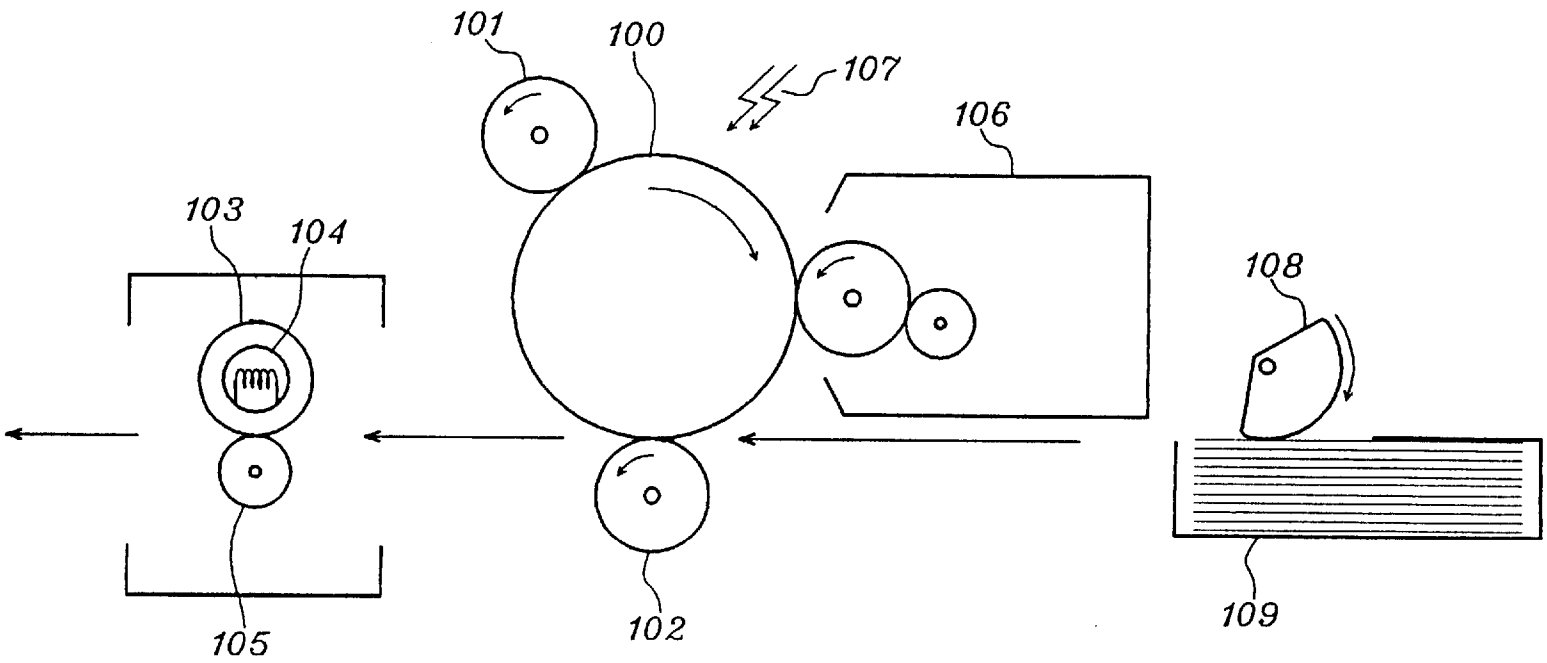
FIG. 1 is a schematic view of inside of a contemporary laser printer.

Turning now to the drawings, FIG. 1 shows a diagrammatic internal scheme of a contemporary laser printer. As shown in this figure, the printer may include a paper feeder including a paper cassette 9 and a pickup roller 8 for supplying papers one by one, a transferring roller 102 mounted in the printer for transferring an electrostatic image on the OPC drum 100 to a paper, and a fusing device for fusing the transferred image on the paper passed through the transferring roller 102. The OPC drum unit and developing device are both detachable from the printer. The OPC drum unit may include an OPC drum 100; a charger roller 101 for charging the peripheral surface of the OPC drum 100 prior to form an electrostatic latent image; an erasing device not shown for making the charge of the peripheral surface of the OPC drum uniformly; and an exposure device 107 for forming an electrostatic latent image on the OPC drum 100 by changing the digital signal into laser beam.

The fusing device may include a heating lamp 104 for heating the device to a predesignated temperature when the print command is inputted; a heating roller 103 surrounding the heating lamp 104 and compressed by a compress roller 105 for fusing the transferred image on the paper by the heat and ejecting the printed paper to outside of the printer, the paper intervening between the same roller 103 and the compress roller 105.

Figure 2:
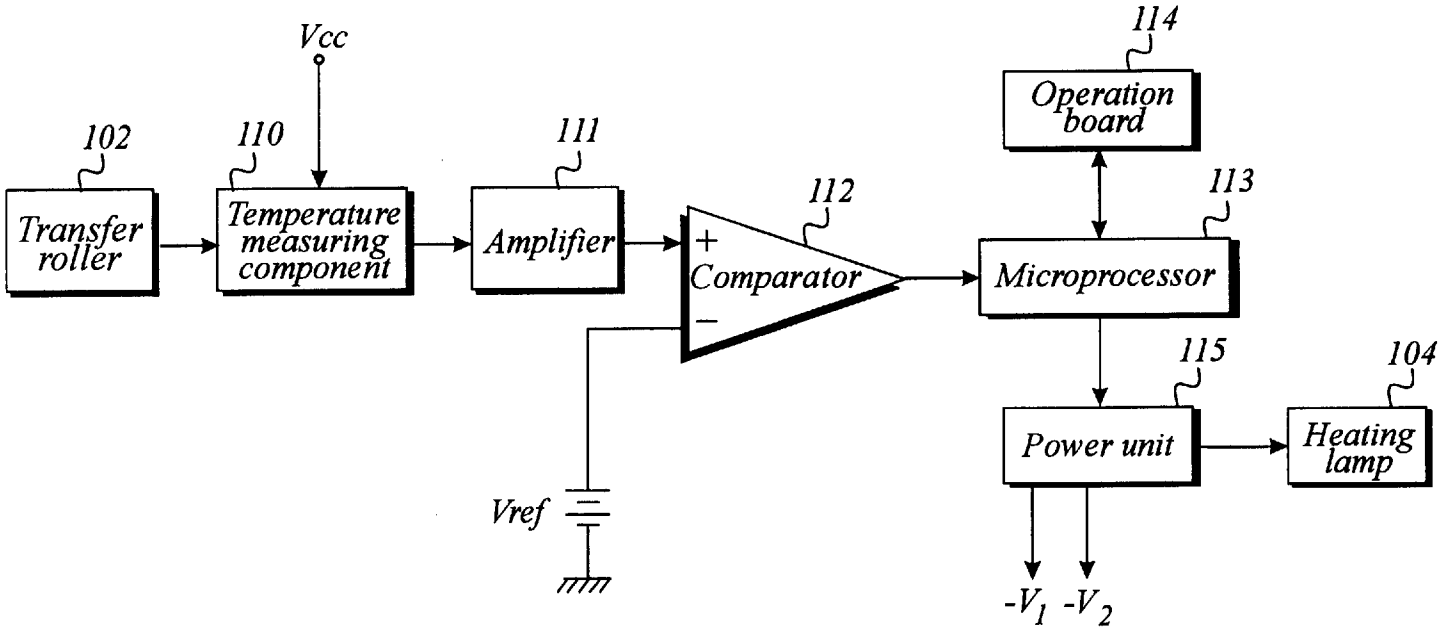
FIG. 2 is a block diagram depicting a fusing device of the printer of FIG. 1.

FIG. 2 shows a block diagram illustrating the fusing device of the laser printer of FIG. 1. The fusing device includes an operation board 114 generating the print command when pressing a corresponding key thereon; a thermometer mounted in the transferring roller 102 for measuring temperature and humidity of the transferring roller 102; an amplifier 111 for increasing the measured results to sufficient voltage; a comparator 112 which compares the amplified voltage and the reference voltage Vref whether or not the two are equal or in agreement and generates an resultant voltage; a microprocessor 113 which controls the entire operation of the image forming apparatus based upon the resultant voltage from the comparator 112 and the mode data from the operation board 114; and a power unit 115 for supplying a charger voltage −V1 and a transfer voltage −V2 depending on the control signal of the microprocessor 113 and supplying a sufficient voltage to the heating lamp 104.

The papers in the paper cassette 9 are fed to the OPC drum unit by one and one through the developing device 106 by means of the pickup roller 8. In this time, rotating in the direction of the rotation of the OPC drum 100, the charger roller 101 charges the peripheral surface of the OPC drum 100 uniformly using the charge voltage −V1 supplied from the power unit 115, and the exposure device 107, for example, laser diode emits the light into the charged portion of the OPC drum 100, whereby creating an electrostatic latent image on the OPC drum surface. Thus formed latent image is changed into the visual image by attracting toner powder of the developing device 106 and the toner image is transferred on a paper by the voltage −V2 of the transferring roller 102, −V2 being supplied from the power unit 115. Each paper having the toner image thereon intervenes and passes between the compress roller 105 and the heating roller 103 heated by the heating lamp 104, so that the toner image is fused and ejected to the outside.

After the initial power is supplied, the microprocessor 113 of FIG. 2 controls the power unit 115 during a set warm-up time. At the same time, the heating lamp 104 of FIG. 1 heats the heating roller 103 to produce energy required to fuse the toner image on the paper. However, in case when power is supplied after the device has been at atmospheric temperature of about 10° C. and humidity of about 30% RH more than two hours, the microprocessor 113 performs the warm-up operation in which the heating lamp 104 is heated through the power unit 115 for a predesignated time. After the warm-up operation, if the print command is inputted through the operation board 114, the microprocessor 113 performs printing as the above-mentioned manner, while if no print command during the predesignated time, the device enters the standby mode.

If the print command is inputted after power is supplied or after the warm-up operation is finished, sufficient heating of the heating roller is impossible due to low ambient temperature and humidity and hence poor fusing of the toner image is inevitable.

Thus, a proposed technique is to employ a temperature measuring component such as a thermistor having a high negative temperature coefficient of resistance to the transferring roller 102. The temperature measuring component 110 measures resistance of the transferring roller 102 to detect the temperature of the transferring roller 102 varied upon ambient temperature through and humidity and supplies a measured voltage corresponding to the temperature to the amplifier 111. The amplifier 111 increases the input voltage and supplies the increased voltage to the comparator 112. As a next step, the comparator 112 compares the input voltage and the reference voltage Vref and delivers the resultant value to the microprocessor 113. Then, the microprocessor 113 controls the power unit 115 for the warm-up time preset on the basis of the normal temperature and temperature to heat the heating lamp 104 only if high potential is inputted, i.e. the inputted resultant value shows somewhat change in the temperature of the transferring roller 102.

Nevertheless, when the print command is inputted in the standby mode or undesirable condition of low temperature, this apparatus heats the heating lamp just only for the set warm-up time, so that sufficient heating can not be expected for the short warm-up time. Accordingly, poor fusing becomes reasonable result. Further, extending the warm-up time with no limitation and turning on the heating lamp just to solve the above-cited problems bring another inefficiency in power consumption.

A better solution may according to one embodiment of the present invention. An image forming apparatus includes a paper feeder including a paper cassette 109 and a pick-up roller 108 in contact with an uppermost paper in the paper cassette for feeding the same one by one; an OPC drum unit including an OPC drum 100, a charger roller 101 for forming an electrostatic latent image on the peripheral surface of the OPC drum 100, an exposure device 107 and a developing device 106; a transfer device including a transferring roller 102 for attracting toner powder to the latent image and transferring the toner image to a paper; a fusing device including a press roller 105, heating lamp 104 and heating roller 103 and fusing the transferred toner image on the same paper intervening between the press roller 105 and the heating roller 103 by means of the heat and pressure; and a microprocessor 113 for supplying power to the OPC drum unit, transfer device and fusing device by controlling the power unit 115.

Figure 4:
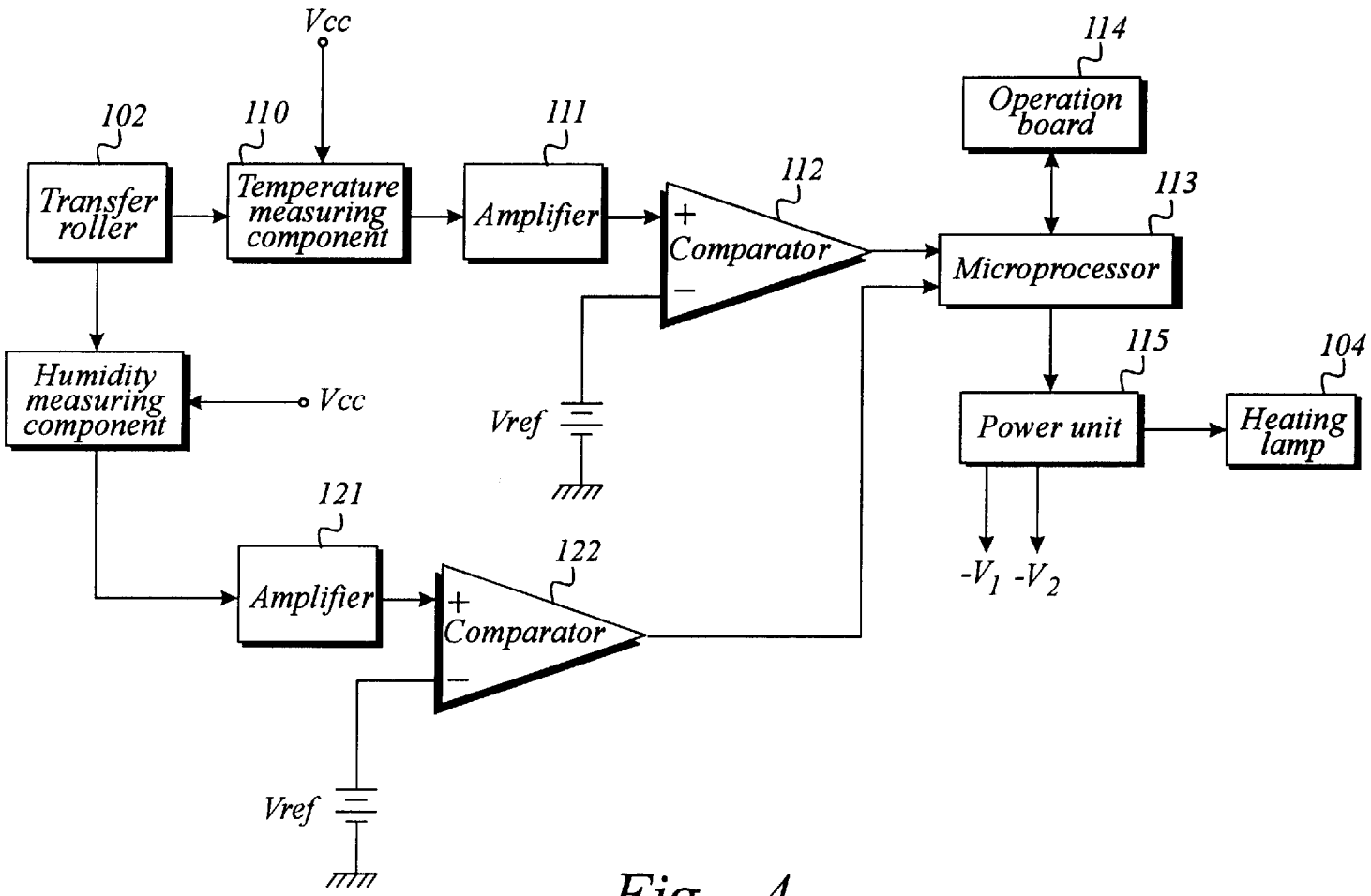
FIG. 4 is a block diagram depicting another fusing device of a laser printer of the present invention.

Another embodiment is shown in FIG. 4. With reference to FIG. 4, parts similar to those previously described with reference to FIGS. 1 and 2 are denoted by the same reference numerals. In addition, FIG. 4 shows the humidity measuring component 120 which measures the transferring roller 102 to detect the humidity of the transferring roller 102 varied upon ambient humidity and supplies a measured voltage corresponding to the humidity to the amplifier 121. On the other hand, the amplifier 121 increases the input voltage and supplies the increased voltage to the comparator 122. As a next step, the comparator 122 compares the input voltage and the reference voltage Vref and delivers the resultant value to the microprocessor 113. This is in contrast to the embodiment shown in FIG. 2, where the microprocessor 113 receives humidity information soley (and not also from humidity measuring component 120) from the measuring component 110 (which also measures temperature) via amplifier 111 and comparator 112.

Figure 3:
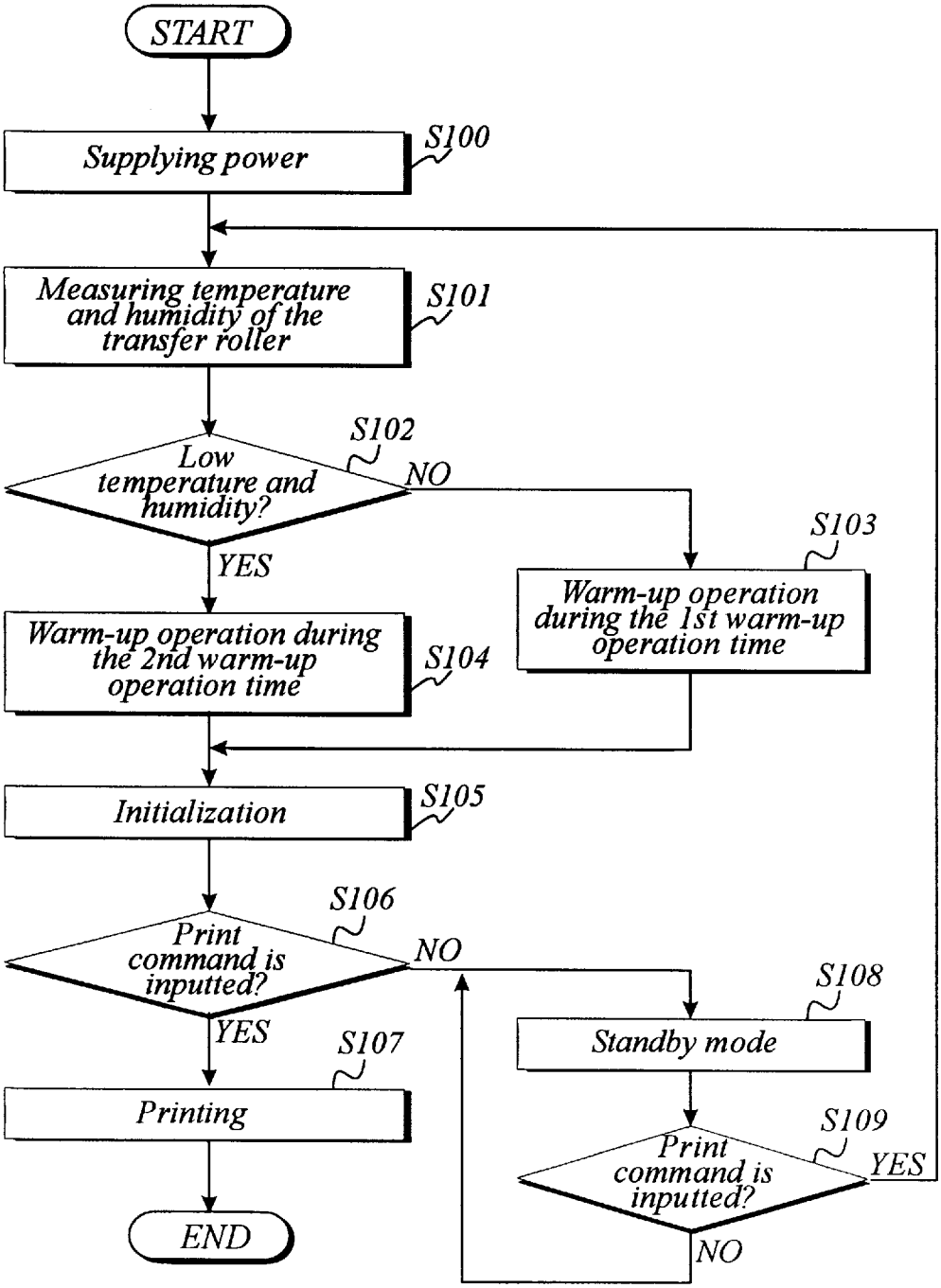
FIG. 3 is a flowchart illustrating the fusing step of a laser printer of the present invention.

With reference to FIG. 3, wherein parts similar to those previously described with reference to FIGS. 1, 2, and 4 are denoted by the same reference numerals, the operation of this apparatus may include supplying power to the image forming apparatus (S100); measuring temperature and humidity of the transferring roller 102 variable 10upon the ambient condition (S101); judging whether or not the ambient condition is at low temperature and low humidity by comparing the measured values and set values (S102); performing warm-up operation by heating the heating lamp 104 of the fusing device during the first set warm-up time t1 if not at low temperature and low humidity (S103); performing warm-up operation by heating the heating lamp 104 of the fusing 15 device during the second set warm-up time ($t2=t1+\alpha$) if at low temperature and low humidity (S104); performing initialization mode after the warm-up operation is finished (S105); fusing the transferred toner image on the paper by controlling the OPC drum unit and the transfer device if a print command is inputted during a predesignated time in the initialization mode (S106); performing the standby mode if no print command is inputted in the initialization mode (S108); either maintaining the same mode continuously if no command is inputted during a predesignated time in the standby mode of S108 or performing the next steps of S100 repeatedly if a command is inputted during the same time (S109), completing the printing process.

Inside the microprocessor 113, there is desirably provided two timers (not shown): one actuates the power unit 115 and counts the first warm-up time t1 if the charger roller 102 is at low temperature and low humidity to heat the heating lamp 104 of the fusing device; and the other actuates the power unit 115 and counts the second warm-up time t2 if the charger roller 102 is not at low temperature and low humidity to heat the heating lamp 104 of the fusing device.

As for time setting in the above situation, it is desirable to set the second warm-up time t2 to be longer than the first warm-up time t1. Initial data indicate the that t2 be longer than t1 by about 10 to 20 sec. When the command is inputted in the standby mode, it is desirable to set the second warm-up time t2 to be longer than the first warm-up time t1, more preferably by about 10 sec. Also, when the initial power is supplied, it is desirable to set the second warm-up time t2 to be longer than the first warm-up time t1 by about 10 sec.

Another embodiment of the present invention will be described with reference to FIGS. 1 and 2. First, when power is supplied to the image forming apparatus by turning on the 20 power switch not shown (S100), the microprocessor 113 judges whether or not the charger roller 102 of which temperature and humidity are varied depending upon the ambient condition is at low temperature and low humidity (S101). This is to supply a constant voltage −V2 to the transferring roller 102 from the power unit 115 even if the temperature of the transferring roller 102 varies. In this step, measuring the temperature of the transferring roller 102 is conducted by means of the temperature measuring device 110 and amplifier 111 as is done similarly to those of FIGS. 1 and 2, and the amplified value is inputted to the comparator 112. The comparator 112 compares the voltage from the amplifier 111 and the reference voltage Vref and delivers the resultant of comparison to the microprocessor 113. Then, the microprocessor 113 judges whether or not the transferring roller 102 is at low temperature and low humidity as the input value from the comparator 112 (S102). Next, if the result is no, i.e. the comparator outputs a low logic potential, the microprocessor 113 controls the power unit 115 and counts the first warm-up time t1 preset on the basis of the normal ambient condition using the timer, performing the warm-up operation for heating the heating roller 104 of the fusing device (S103).

After such a warm-up process, the initialization mode starts (S105). However, if the result is yes, i.e. the comparator outputs a high logic potential, the microprocessor 113 controls the power unit 115 and counts the second warm-up time t2 preset on the basis of low temperature and low humidity using another timer, performing the warm-up operation for heating the heating roller 104 of the fusing device (S104). In the above, the second warm-up time t2 can be expressed by (t1+α) and a predesignated time a is desirable within 10 to 20 sec. After such a warm-up, the initialization mode starts (S105).

The microprocessor 113 judges whether or not a print command is inputted through the operation board 114 (S106) during a set time in the mode of S105, and, if the command is inputted, controls the power unit 115 to supply voltage −V1 and −V2 to the charger roller 101 and the transferring roller 101, respectively and to supply a suitable voltage to the heating lamp 104, completing the print operation correctly (S107). Whereas, if no command is inputted in the initialization mode, the mode is changed into the standby mode (S108). As a next step, the microprocessor 113 judges whether or not a print command is inputted (S109), and maintains the standby mode if no command is inputted.

However, the entire steps, only omitting the initialization mode of S105, can be performed again ("reperformed") if the command is inputted, so that the print is completed (S107). At this point, since the heating lamp has been already heated more or less in the standby mode, it is desirable that the second warm-up time is longer than the first warm-up time by about 10 sec.

As illustrated in the above, when the copier and the printer, or the like start warm-up operation in response to power-on after having been at low temperature and low humidity for a long time or when they start reoperating in the standby mode after having been at low temperature and low humidity for a long time, it is desirable to set the warm-up time to be longer than that of the normal condition by 10 to 20 sec to obtain good fusing result. Further obtainable advantage is the minimizing of the power consumption; it is unnecessary to extend the warm-up time without limitation, turning on the heating lamp during the same time and turning on the heating lamp is only required in somewhat special condition such as low temperature and low humidity.

What is claimed is:

1. A method of fusing image using an image forming apparatus including a paper feeder, a photosensitive device having a drum to form an electrostatic latent image on the peripheral surface of the drum, a transferring device to supply toner powder to the electrostatic latent image and to transfer a toner image on a paper, and a fusing device for fusing the toner image on the paper, said method comprising the steps of:

measuring ambient temperature and humidity of the transferring device when power is supplied and judging whether the transferring device is at below a predetermined temperature and below a predetermined humidity;

after said judging, when the transferring device is not below the predetermined time and below a predetermined humidity, heating the fusing device for a first warm-up time;

after said judging, when the transferring device is below the predetermined temperature and below the predetermined humidity, heating the fusing device for a second warm-up time; and when a print command is received after heating of the fusing device, completing a print process by controlling the photosensitive device and the transferring device and fusing the transferred toner image on the paper.

2. The method of claim 1, wherein the second warm-up time is longer than the first warm-up time.

3. The method of claim 2, wherein difference between the second warm-up time and the first warm-up time is greater than ten seconds.

4. The method of claim 1, wherein difference between the second warm-up time and the first warm-up time is less than twenty seconds.

5. The method of claim 1, wherein the drum is an organic photoconductive drum.

6. A method of fusing image using an image forming apparatus including a paper feeder, a photosensitive device having a drum to form an electrostatic latent image on the peripheral surface of the drum, a transferring device to supply toner powder to the electrostatic latent image and to transfer a toner image on a paper, and a fusing device for fusing the toner image on the paper, said method comprising the steps of:

when a print command is received during a standby mode without full operation of said image forming apparatus and after power is supplied, measuring ambient temperature and humidity of the transferring device when power is supplied and judging whether the transferring device is at below a predetermined temperature and below a predetermined humidity;

after said judging, when the transferring device is not below the predetermined time and below a predetermined humidity, heating the fusing device for a first warm-up time; and after said judging, when the transferring device is below the predetermined temperature and below the predetermined humidity, heating the fusing device for a second warm-up time.

7. The method of claim 6, wherein the second warm-up time is longer than the first warm-up time.

8. The method of claim 7, wherein difference between the second warm-up time and the first warm-up time is greater than ten seconds.

9. The method of claim 7, wherein difference between the second warm-up time and the first warm-up time is about ten seconds when the print command is received during the standby mode.

10. The method of claim 9, wherein difference between the second warm-up time and the first warm-up time is about ten seconds when initial power is supplied.

11. The method of claim 6, wherein difference between the second warm-up time and the first warm-up time is less than twenty seconds.

12. The method of claim 6, wherein the drum is an organic photoconductive drum.

13. A method of fusing image using an image forming apparatus including a paper feeder, a photosensitive device having a drum to form an electrostatic latent image on the peripheral surface of the drum, a transferring device to supply toner powder to the electrostatic latent image and to transfer a toner image on a paper, and a fusing device for fusing the toner image on the paper, said method comprising the steps of:

measuring ambient temperature and humidity of the transferring device when power is supplied and judging whether the transferring device is at below a predetermined temperature and below a predetermined humidity;

after said judging, when the transferring device is not below the predetermined time and below a predetermined humidity, heating the fusing device for a first warm-up time and entering an initialization mode of initializing said image forming apparatus;

after said judging, when the transferring device is below the predeterminded temperature and below the predetermined humidity, heating the fusing device for a second warm-up time and entering the initialization mode;

when a print command is received during the initialization mode, completing a print process by controlling the photosensitive device and the transferring device and fusing the transferred toner image on the paper;

when no print command is received during the initialization mode, entering a standby mode without full operation of said image forming apparatus; and when a print command is received during the standby mode, completing a print process by controlling the photosensitive device and the transferring device and fusing the transferred toner image on the paper.

14. The method of claim 13, wherein the second warm-up time is longer than the first warm-up time.

15. The method of claim 14, wherein difference between the second warm-up time and the first warm-up time is greater than ten seconds.

16. The method of claim 13, wherein difference between the second warm-up time and the first warm-up time is less than twenty seconds.

17. The method of claim 13, wherein the drum is an organic photoconductive drum.

18. The method of claim 13, wherein difference between the second warm-up time and the first warm-up time is about ten seconds when the print command is received during the standby mode.

* * * * *